US010641115B2

(12) United States Patent
Colebrook

(10) Patent No.: US 10,641,115 B2
(45) Date of Patent: May 5, 2020

(54) SEGMENTED CONDUIT WITH AIRFOIL GEOMETRY

(71) Applicant: UNITED TECHNOLOGIES CORPORATION, Farmington, CT (US)

(72) Inventor: Mark W. Colebrook, Glastonbury, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 171 days.

(21) Appl. No.: 15/689,890

(22) Filed: Aug. 29, 2017

(65) Prior Publication Data

US 2019/0063241 A1 Feb. 28, 2019

(51) Int. Cl.

| | |
|---|---|
| ***F01D 9/04*** | (2006.01) |
| ***F01D 25/26*** | (2006.01) |
| ***F01D 9/06*** | (2006.01) |
| ***F01D 25/24*** | (2006.01) |

(52) U.S. Cl.

CPC ..... *F01D 9/041* (2013.01); *F01D 9/06* (2013.01); *F01D 9/065* (2013.01); *F01D 25/24* (2013.01); *F01D 25/26* (2013.01); *F05D 2230/50* (2013.01); *F05D 2230/51* (2013.01); *F05D 2230/60* (2013.01)

(58) Field of Classification Search

CPC . F01D 9/041; F01D 9/06; F01D 25/24; F01D 9/065; F01D 25/26; F01D 1/04; F01D 1/06; F05D 2230/50; F05D 2230/51; F05D 2230/60; F03D 1/04; F03D 3/04; F04D 19/022

USPC ..... 415/208.2, 298.2

See application file for complete search history.

(56) References Cited

U.S. PATENT DOCUMENTS 3,611,976 A * 10/1971 Hale ..... B63B 21/663 114/243

5,678,504 A 10/1997 Toplosky et al.

(Continued)

FOREIGN PATENT DOCUMENTS

| | | |
|---|---|---|
| EP | 1553262 | 7/2005 |
| EP | 3208427 | 8/2017 |
| FR | 3025884 | 3/2016 |

(Continued)

OTHER PUBLICATIONS

European Patent Office, European Search Report dated Dec. 12, 2018 in Application No. 18191296.5.

*Primary Examiner* — Joseph J Dallo
*Assistant Examiner* — Scott A Reinbold
(74) *Attorney, Agent, or Firm* — Snell & Wilmer L.L.P.

(57) ABSTRACT

A conduit that includes a first segment forming a first sidewall of the conduit and a second segment forming a second sidewall of the conduit. The first segment may include a first inner surface and a first outer surface and the second segment may include a second inner surface and a second outer surface. The first segment may be coupled to the second segment such that the first inner surface and the second inner surface jointly form an inner conduit surface and the first outer surface and the first inner surface jointly form at least a portion of an outer conduit surface, wherein the outer conduit surface has an airfoil geometry. The first segment and the second segment may be detachably coupled together.

13 Claims, 6 Drawing Sheets

(56) References Cited

U.S. PATENT DOCUMENTS

| | | | | |
|---|---|---|---|---|
| 2013/0336782 | A1* | 12/2013 | Ryczek | F01D 25/14<br>415/208.1 |
| 2016/0006226 | A1* | 1/2016 | Moisei | F01D 17/02<br>174/72 R |

FOREIGN PATENT DOCUMENTS

| | | | | |
|---|---|---|---|---|
| GB | 2402266 | | 7/2006 | |
| GB | 2402266 B | * | 7/2006 | B63B 21/663 |

* cited by examiner

SEGMENTED CONDUIT WITH AIRFOIL GEOMETRY

FIELD

The present disclosure relates to conduits, and more specifically, to conduits extending across fluid flow regions.

BACKGROUND

In various applications, cables or pipes are routed from one location to another. For example, in a gas turbine engine, cables and/or pipes/tubes carrying fluid may extend across a fan bypass region between a split fan duct and an internal core cowl or heat shield. Such regions may be subject to high velocity air, and exposing cables, pipes, or mounting harnesses/hardware to these high velocity air regions may adversely affect the durability and/or operability of said cables, pipes, or mounting harnesses/hardware. While conventional conduits may be utilized to provide a degree of shielding to the contained cables or pipes, conventional conduits can adversely affect the aerodynamics of the high velocity region and/or it is often difficult to install and route cables or pipes through conventional conduits.

SUMMARY

In various embodiments, the present disclosure provides a conduit having a first segment forming a first sidewall of the conduit and a second segment forming a second sidewall of the conduit. The first segment includes a first inner surface and a first outer surface and the second segment includes a second inner surface and a second outer surface, according to various embodiments. The first segment is coupled to the second segment such that the first inner surface and the second inner surface jointly form an inner conduit surface and the first outer surface and the first inner surface jointly form at least a portion of an outer conduit surface, according to various embodiments. The outer conduit surface may have an airfoil geometry.

In various embodiments, the first segment and the second segment are detachably coupled together. In various embodiments, the first outer surface at least partially forms one of an upper surface and a lower surface of the airfoil geometry of the outer conduit surface and the second outer surface at least partially forms the other of the upper surface and the lower surface of the airfoil geometry of the outer conduit surface. The conduit may further include a third segment and a fourth segment. The third segment couples the first segment to the second segment and forms a leading edge portion of the airfoil geometry of the outer conduit surface, wherein the fourth segment couples the first segment to the second segment and forms a trailing edge portion of the airfoil geometry of the outer conduit surface, according to various embodiments.

In various embodiments, the first segment includes a first longitudinal edge and a second longitudinal edge and the second segment includes a third longitudinal edge and a fourth longitudinal edge. The first longitudinal edge is coupled to the third longitudinal edge and the second longitudinal edge is coupled to the fourth longitudinal edge. As mentioned above, the conduit may further include a third segment and a fourth segment, wherein the first longitudinal edge is indirectly coupled to the third longitudinal edge via the third segment and the second longitudinal edge is indirectly coupled to the fourth longitudinal edge via the fourth segment. The third segment may form a leading edge portion of the airfoil geometry of the outer conduit surface and the fourth segment may form a trailing edge portion of the airfoil geometry of the outer conduit surface. In various embodiments, the third segment is configured to be in longitudinal sliding engagement with the first longitudinal edge and the third longitudinal edge. In various embodiments, the fourth segment is configured to be in longitudinal sliding engagement with the second longitudinal edge and the fourth longitudinal edge.

In various embodiments, the third segment and the fourth segment are unitary. In various embodiments, the third segment comprises one of a slot geometry and a complementary tab geometry, wherein the first longitudinal edge and the third longitudinal edge jointly form the other of the slot geometry and the complementary tab geometry. In various embodiments, the fourth segment comprises one of a slot geometry and a complementary tab geometry, wherein the second longitudinal edge and the fourth longitudinal edge jointly form the other of the slot geometry and the complementary tab geometry.

Also disclosed herein, according to various embodiments, is a gas turbine engine that includes a first case structure, a second case structure, and a conduit extending between the first case structure and the second case structure. The conduit may have an outer conduit surface having an airfoil geometry and the conduit may include a plurality of detachably coupled segments.

In various embodiments, the plurality of detachably coupled segments includes a first segment forming a first sidewall of the conduit and a second segment forming a second sidewall of the conduit. In various embodiments, the first segment at least partially forms one of an upper surface and a lower surface of the airfoil geometry of the outer conduit surface and the second segment at least partially forms the other of the upper surface and the lower surface of the airfoil geometry of the outer conduit surface. In various embodiments, the conduit further includes a third segment and a fourth segment. The third segment may couple the first segment to the second segment and may form a leading edge portion of the airfoil geometry of the outer conduit surface. The fourth segment may couple the first segment to the second segment and may form a trailing edge portion of the airfoil geometry of the outer conduit surface. In various embodiments, the first case structure is radially outward of and concentric with the second case structure such that the conduit extends substantially radially, relative to an engine central longitudinal axis of the gas turbine engine.

Also disclosed herein, according to various embodiments, is a method of assembling a gas turbine engine. The method may include inserting a first segment of a conduit through a first aperture formed in a first case structure of the gas turbine engine. The method may further include positioning at least one of an electronics cable and a tube for fluids relative to the first segment of the conduit. Still further, the method may include inserting a second segment of the conduit through the first aperture formed in the first case structure of the gas turbine engine and coupling the first segment to the second segment, wherein an outer conduit surface of the conduit has an airfoil geometry.

In various embodiments, positioning the at least one of the electronics cable and the tube for fluids comprises mounting the at least one of the electronics cable and the tube for fluids to the first segment. In various embodiments, coupling the first segment to the second segment comprises sliding a third segment along respective longitudinal edges of the first segment and the second segment to interlock the third segment to both the first segment and the second segment.

In various embodiments, coupling the first segment to the second segment includes sliding a fourth segment along other respective longitudinal edges of the first segment and the second segment to interlock the fourth segment to both the first segment and the second segment.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
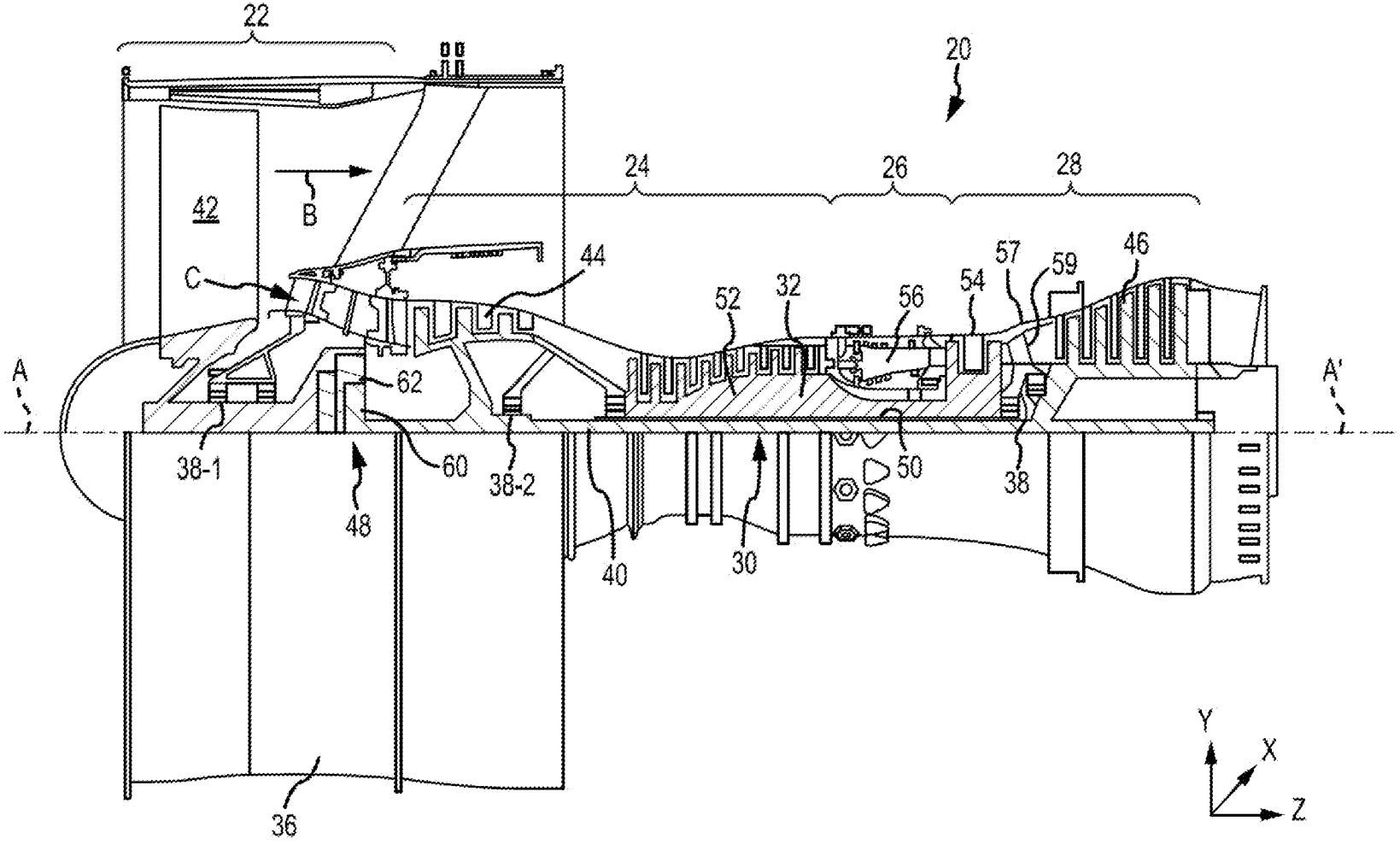
FIG. 1 is a cross-sectional view of an exemplary gas turbine engine, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

Disclosed herein, according to various embodiments, is a segmented conduit that has an airfoil geometry. Accordingly, as described in greater detail below, the conduit is made from multiple segments, thus improving the ease of installation/assembly relative to conventional conduits, and is configured to have an outer conduit surface that has an airfoil geometry, thereby decreasing the aerodynamic drag created by conventional conduits and thereby improving the durability and/or operational life of the conduit and the components routed there-through. Throughout the present disclosure, the term "airfoil geometry" refers to the outer conduit surface having an aerodynamically favorable shape in response to directional flow of fluid (e.g., air) in the region into which or across which the conduit extends. Thus, the term "airfoil geometry" means that the conduit has a leading edge portion and a trailing edge portion connected by an upper/suction surface and a lower/pressure surface, according to various embodiments. While numerous details are included herein pertaining to conduits installed in an extending across regions in a gas turbine engine, the scope of the present disclosure is not limited to gas turbine engines. Thus, the conduit provided herein may be utilized in various applications.

In various embodiments and with reference to FIG. 1, a gas turbine engine 20 is provided. Gas turbine engine 20 may be a two-spool turbofan that generally incorporates a fan section 22, a compressor section 24, a combustor section 26 and a turbine section 28. Alternative engines may include, for example, an augmentor section among other systems or features. In operation, fan section 22 can drive fluid (e.g., air) along a bypass flow-path B while compressor section 24 can drive fluid along a core flow-path C for compression and communication into combustor section 26 then expansion through turbine section 28. Although depicted as a turbofan gas turbine engine 20 herein, it should be understood that the concepts described herein are not limited to use with turbofans as the teachings may be applied to other types of turbine engines including three-spool architectures.

Gas turbine engine 20 may generally comprise a low speed spool 30 and a high speed spool 32 mounted for rotation about an engine central longitudinal axis A-A' relative to an engine static structure 36 or engine case via several bearing systems 38, 38-1, and 38-2. Engine central longitudinal axis A-A' is oriented in the z direction (axial direction) on the provided xyz axis. The y direction on the provided xyz axis refers to radial directions and the x direction on the provided xyz axis refers to the circumferential direction. It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low pressure compressor 44 and a low pressure turbine 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high pressure compressor 52 and high pressure turbine 54.

A combustor 56 may be located between high pressure compressor 52 and high pressure turbine 54. The combustor section 26 may have an annular wall assembly having inner and outer shells that support respective inner and outer heat shielding liners. The heat shield liners may include a plurality of combustor panels that collectively define the annular combustion chamber of the combustor 56. An annular cooling cavity is defined between the respective shells and combustor panels for supplying cooling air. Impingement holes are located in the shell to supply the cooling air from an outer air plenum and into the annular cooling cavity.

A mid-turbine frame 57 of engine static structure 36 may be located generally between high pressure turbine 54 and low pressure turbine 46. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor 44 then high pressure compressor 52, mixed and burned with fuel in combustor 56, then expanded over high pressure turbine 54 and low pressure turbine 46. Turbines 46, 54 rotationally drive the respective low speed spool 30 and high speed spool 32 in response to the expansion.

In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). In various embodiments, the bypass ratio of gas turbine engine 20 is greater than about ten (10:1). In various embodiments, the diameter of fan 42 may be significantly larger than that of the low pressure compressor 44, and the low pressure turbine 46 may have a pressure ratio that is greater than about five (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other gas turbine engines including direct drive turbofans. A gas turbine engine may comprise an industrial gas turbine (IGT) or a geared aircraft engine, such as a geared turbofan, or non-geared aircraft engine, such as a turbofan, or may comprise any gas turbine engine as desired.

Figure 2:
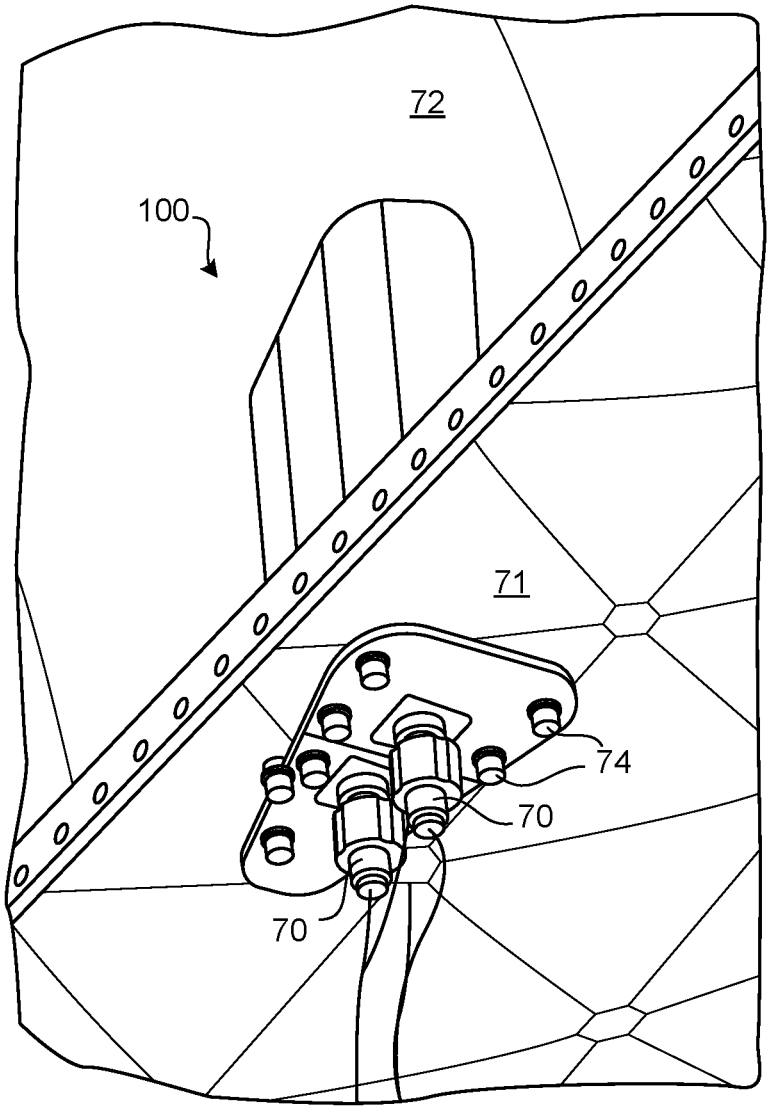
FIG. 2 is a perspective view of a conduit extending between two structures, in accordance with various embodiments.

In various embodiments, and with reference to FIG. 2, a conduit 100 is provided for protecting cables and/or tubes/pipes 70. That is, the conduit 100 may extend from a first structure 71, such as a first case structure of gas turbine engine 20, and may protrude into a fluid flow region. In various embodiments, the conduit 100 extends between two structures 71, 72, such as a first case structure and a second case structure of gas turbine engine 20. For example, the first case structure 71 may be a split fan duct and the second case structure 72 may be an internal core cowl or heat shield, and the conduit 100 may extend across a fan bypass region. In various embodiments, the first case structure 71 is radially outward of and concentric with the second case structure 72 such that the conduit 100 extends substantially radially in the gas turbine engine 20. Generally, the conduit 100 is made from a plurality of segments (e.g., a plurality of detachably coupled segments) that may be separately installed, thereby facilitating routing of cables or pipes 70 through the conduit 100. Further, the segments of the conduit 100 jointly form an outer conduit surface having an airfoil geometry. In various embodiments, the conduit 100 may be configured to be installed in high velocity fluid flow regions, such as regions/volumes of the gas turbine engine 20.

Figure 3A:
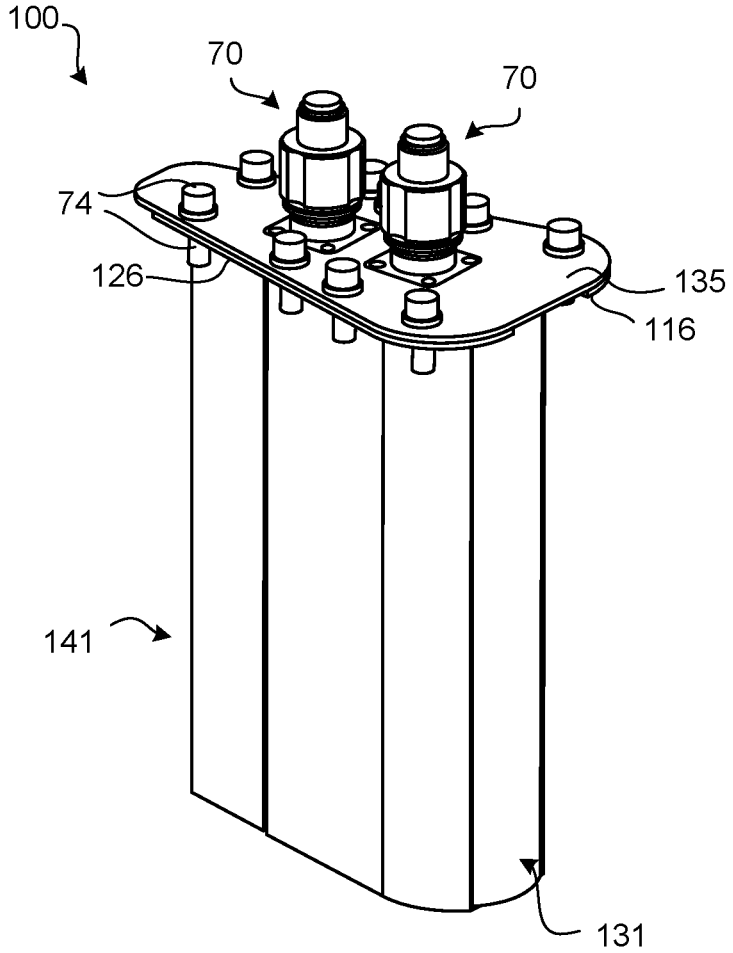
FIG. 3A is a perspective view of a conduit having an outer conduit surface that has an airfoil geometry, in accordance with various embodiments.
Figure 3B:
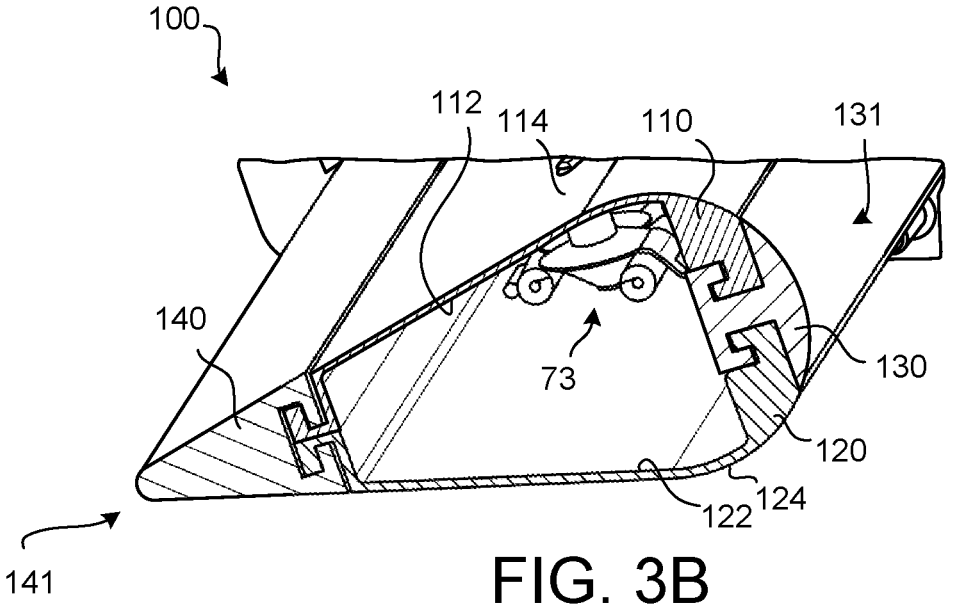
FIG. 3B is a perspective cross-sectional view of a conduit having a first segment, a second segment, a third segment, and a fourth segment that jointly form an outer conduit surface having an airfoil geometry, in accordance with various embodiments.

In various embodiments, and with reference to FIGS. 3A and 3B, the conduit 100 includes a first segment 110 forming a first sidewall of the conduit 100 and a second segment 120 forming a second sidewall of the conduit 100. The first segment 110 may include a first inner surface 112 and a first outer surface 114 and the second segment 120 may include a second inner surface 122 and a second outer surface 124. The first segment 110 is coupled to the second segment 120 of the conduit 100 such that the first inner surface 112 and the second inner surface 122 jointly form an inner conduit surface and the first outer surface 114 and the second outer surface 124 jointly form at least a portion of an outer conduit surface, according to various embodiments. The outer conduit surface (jointly formed by respective outer surfaces of the first and second segment 110, 120) may have an airfoil geometry. The airfoil geometry facilitates the flow of fluid around the conduit 100, thus decreasing structural wear on the conduit 100 and/or improving the flow efficiency of the fluid in the region into which (e.g., across which) the conduit 100 extends.

In various embodiments, the first and second segments 110, 120 are detachably coupled together, as described in greater detail below with reference to FIGS. 4A, 4B, 4C, 5A, and 5B. In various embodiments, the first outer surface 114 at least partially forms either an upper surface or a lower surface of an airfoil shape (e.g., a pressure surface or a suction surface) while the second outer surface 124 at least partially forms the other of the upper or the lower surface of an airfoil shape. In various embodiments, the conduit 100 further includes a third segment 130 and a fourth segment 140. The third segment 130 couples the first segment 110 to the second segment 120, or at least may enable or facilitate the coupling between the first segment 110 and the second segment 120, and may form a leading edge portion 131 of the airfoil geometry of the outer conduit surface. Similarly, the fourth segment 140 couples the first segment 110 to the second component 120, or at least may enable or facilitate the coupling between the first segment 110 and the second segment 120, and may form a trailing edge portion 141 of the airfoil geometry of the outer conduit surface. Thus, the first, second, third, and fourth segments 110, 120, 130, 140 may jointly form the airfoil geometry.

In various embodiments, and with reference to FIG. 3A, the first segment 110 may include a first flange 116 and the second segment 120 may include a second flange 126. The first flange 116 and the second flange 126 may abut and engage a cap flange 135. The wiring/cables 70 may be routed through the cap flange 135. The first and second flanges 116, 126 may be coupled to the cap flange 135 and/or to the corresponding case structure 71 via one or more attachment features 74 (e.g., studs, bolts, etc.). In various embodiments, and with reference to FIG. 3B, component 73, which may be a harness or other hardware, may be mounted within the conduit 100 and may facilitate the retention of the wire/cable/tube 70 within the conduit 100. Additional details pertaining to a method of installing/assembling the conduit 100 are described in greater detail below with reference to FIG. 6.

Figure 4A:
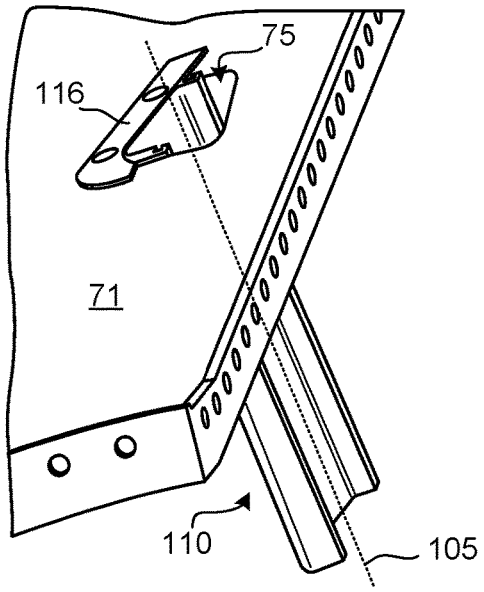
FIG. 4A is a perspective view of a first segment of a conduit being installed in an aperture of a first structure, in accordance with various embodiments.
Figure 4B:
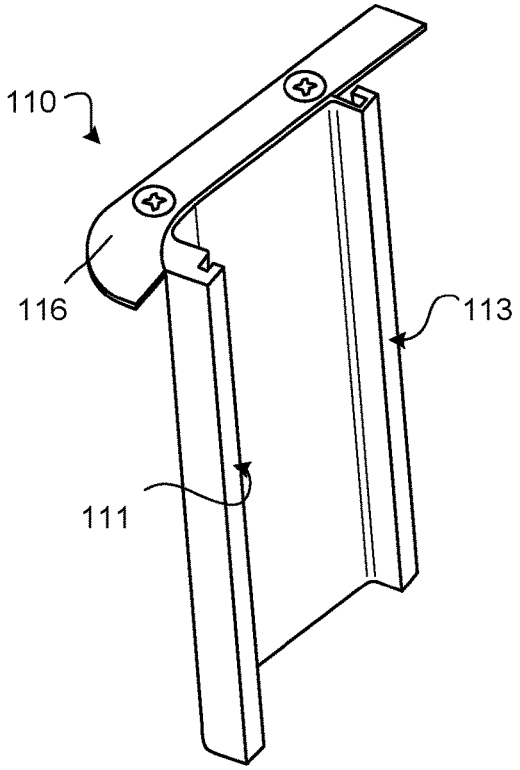
FIG. 4B is a perspective view of a first segment of a conduit, in accordance with various embodiments.
Figure 4C:
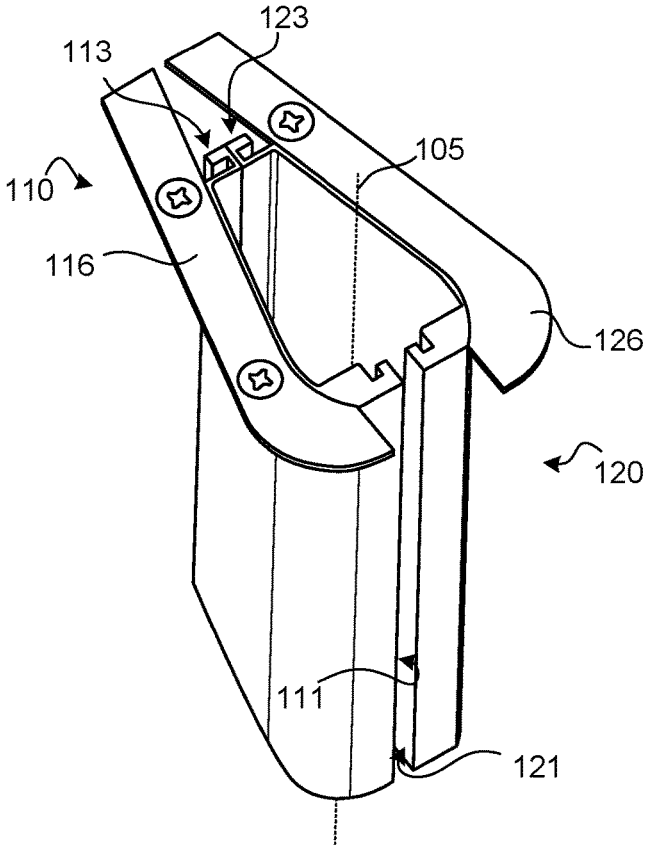
FIG. 4C is a perspective view of a first segment and a second segment of a conduit, in accordance with various embodiments.

In various embodiments, and with reference to FIGS. 4A, 4B, and 4C, the first segment 110 includes a first longitudinal edge 111 and a second longitudinal edge 113 and the second segment 120 includes a third longitudinal edge 121 and a fourth longitudinal edge 123. These longitudinal edges 111, 113, 121, 123 generally extend parallel to the longitudinal axis 105 of the conduit 100 (e.g., extend generally in the extension direction of the conduit 100 across the fluid flow region). The first longitudinal edge 111 of the first segment 110 may be disposed adjacent to the third longitudinal edge 121 of the second segment 120 (FIG. 4C) and the second longitudinal edge 113 of the first segment 110 may be disposed adjacent to the fourth longitudinal edge 123 of second segment 120. In various embodiments, the first and third longitudinal edges 111, 121 may be directly coupled together and the second and fourth longitudinal edges 113, 123 may be directly coupled together.

Figure 5A:
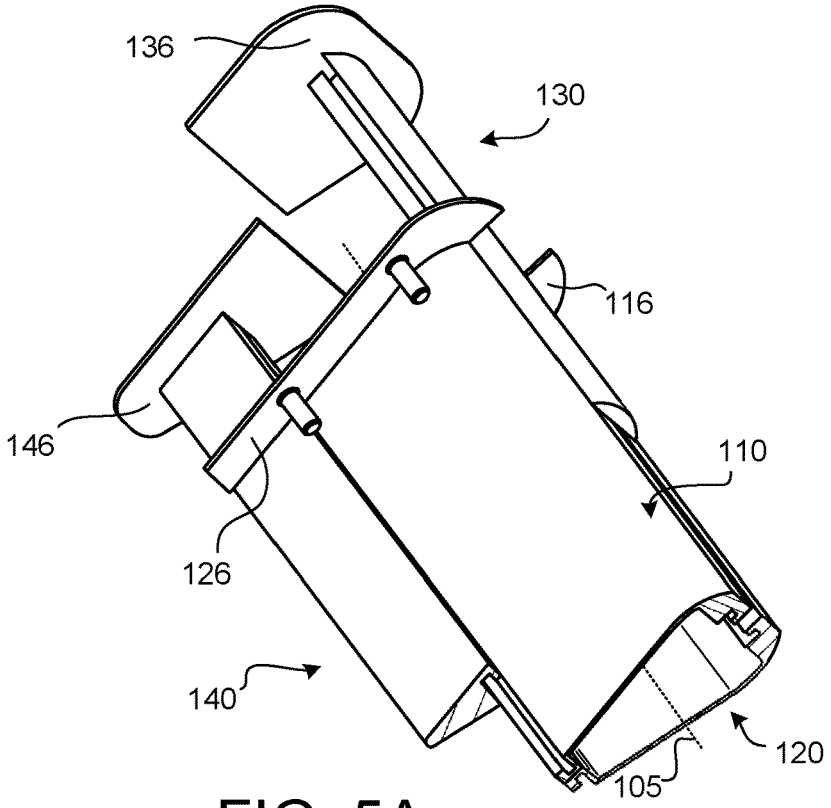
FIG. 5A is a perspective view of conduit having a first segment, a second segment, a third segment, and a fourth segment, in accordance with various embodiments.
Figure 5B:
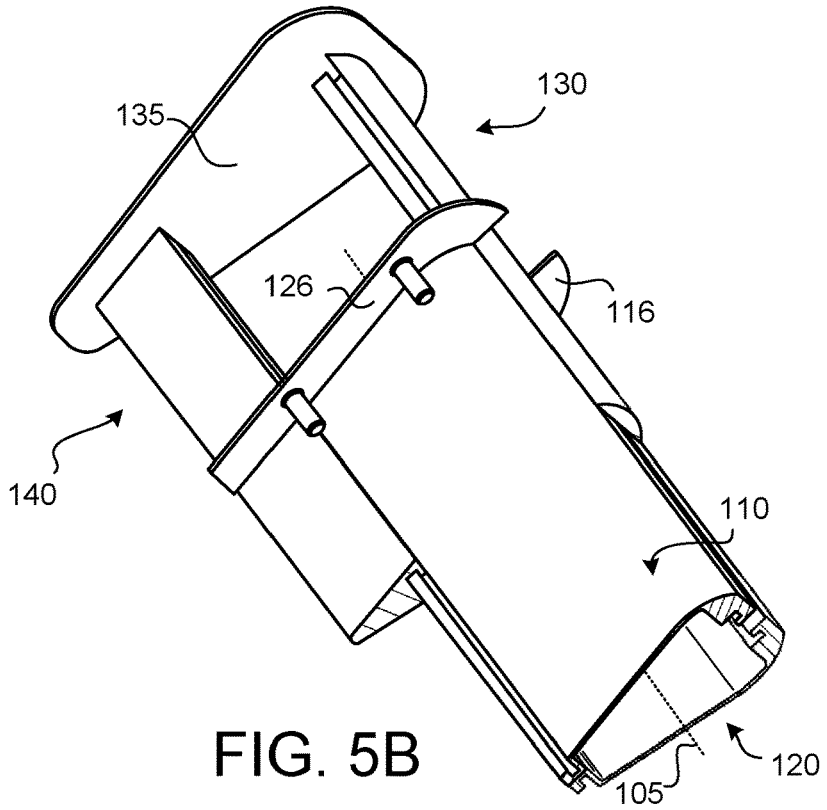
FIG. 5B is a perspective view of conduit having a first segment, a second segment, a third segment, and a fourth segment, with the third segment unitary with the fourth segment, in accordance with various embodiments.

In various embodiments, and with reference to FIGS. 3B, 5A, and 5B, the first and third longitudinal edges 111, 121 and the second and fourth longitudinal edges 113, 123 may be configured to be indirectly coupled together via the third and fourth segments 130, 140 respectively. For example, the third segment 130 may be configured to be in longitudinal sliding engagement with the first longitudinal edge 111 and the third longitudinal edge 121. Similarly, the fourth segment 140 may be configured to be in longitudinal sliding engagement with the second longitudinal edge 113 and the further longitudinal edge 123. In various embodiments, engagement of the third and fourth segments 130, 140 along corresponding longitudinal edges 111, 113, 121, 123 of the first and second segments 110, 120 is accomplished via an interlocking slot-tab structure. For example, the third segment 130 may include either a slot geometry or a complementary tab geometry while the first longitudinal edge 111 and the third longitudinal edge 121 jointly form the other of either the slot geometry or the complementary tab geometry. Similarly, the fourth segment 140 may include either a slot geometry or a complementary tab geometry while the second longitudinal edge 113 and the fourth longitudinal edge 123 jointly form the other of the either the slot geometry or the complementary tab geometry. While various examples of interlocking slot-tab structures are provided in the figures, the scope of the present disclosure is not limited to the configurations shown.

In various embodiments, and with reference to FIGS. 5A, 5B, the third and fourth segments 130, 140 are shown partially installed along the respective longitudinal edges 111, 113, 121, 123 of the first and second segments 110, 120. In various embodiments, and with reference to FIG. 5A, the third segment 130 is separate from the further segment 140. Accordingly, the third segment 130 may have a third flange 136 and the fourth segment 140 may have a fourth flange 146. The third flange 136 and the fourth flange 146 may jointly form the cap flange 135 described above with reference to FIG. 3A. However, in various embodiments, and with reference to FIG. 5B, the third segment 130 and the fourth segment 140 may be unitary and thus may have a common flange that is the cap flange 135 described above with reference to FIG. 3A.

Figure 6:
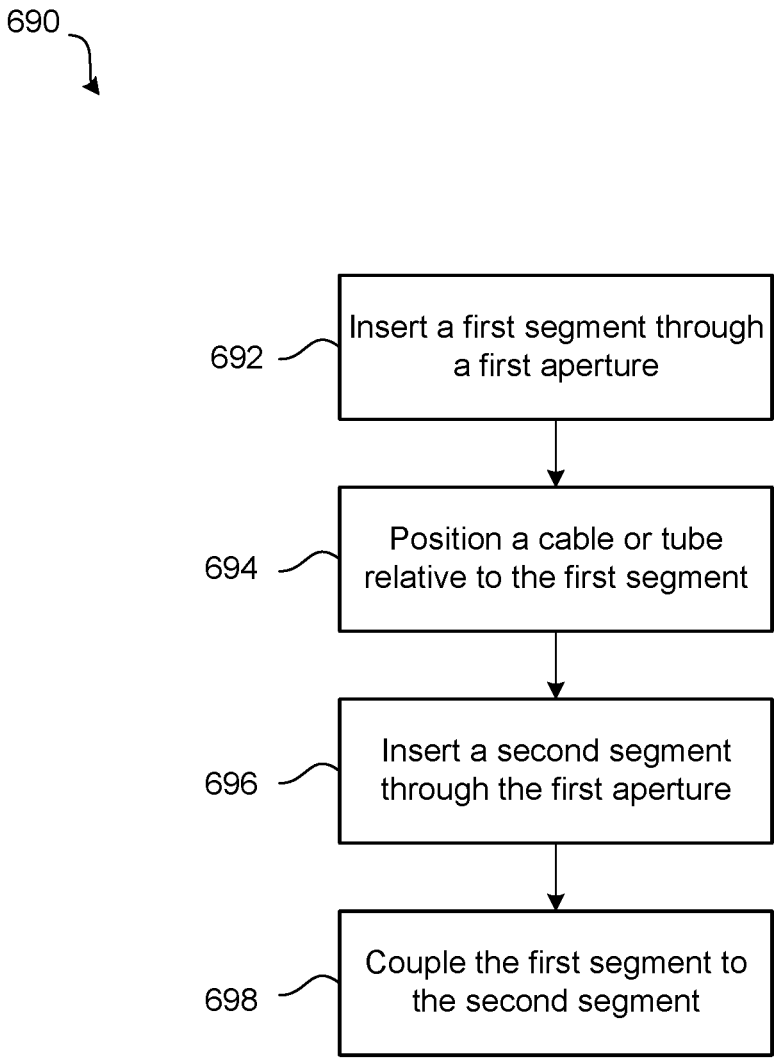
FIG. 6 is a schematic flow chart diagram of a method of assembling a gas turbine engine, in accordance with various embodiments.

In various embodiments, and with reference to FIG. 6, a method 690 of assembling a gas turbine engine 20 is provided. The method 690 may include inserting the first segment 110 through a first aperture 75 (e.g., see FIG. 4A) at step 692. The aperture 75 may be formed/defined in the first case structure 71 of the gas turbine engine 20. The method 690 may further include positioning a cable or tube 70 relative to the first segment 110 at step 694. As mentioned above, the cable or tube 70 may be an electronics cable or a tube/pipe for fluids. In various embodiments, the method 690 further includes inserting a second segment 120 through the first aperture 75 at step 696. The method 690 may further include coupling the first segment 110 to the second segment 120 at step 698. The outer conduit surface that is jointly formed by the first and second segments 110, 120 may have an airfoil geometry. In various embodiments, steps 696 and 698 may be performed after step 694, thus enabling the cable or tube 70 to be easily routed within/mounted to the first segment 110 at step 694 before enclosing the conduit chamber with the second segment 120 via steps 696, 698. In various embodiments, the method 690 may be performed even if a user only has access to the first case structure 71 (and not the second case structure 72).

In various embodiments, step 698 (i.e., coupling the first segment 110 to the second segment 120) includes sliding the third segment 130 along respective longitudinal edges 111, 121 to interlock the third segment 130 to both the first segment 110 and the second segment 120. Similarly, step 698 (i.e., coupling the first segment 110 to the second segment 120) includes sliding the fourth segment 140 along respective longitudinal edges 113, 123 to interlock the fourth segment 140 to both the first segment 110 and the second segment 120.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it may be within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A conduit comprising:

a first segment forming a first sidewall of the conduit, the first segment comprising a first inner surface and a first outer surface;

a second segment forming a second sidewall of the conduit, the second segment comprising a second inner surface and a second outer surface; and a third segment and a fourth segment, wherein the third segment is monolithic with the fourth segment such that the third segment and the fourth segment comprise a common cap flange extending between the third segment and the fourth segment;

wherein the first inner surface and the second inner surface jointly form an inner conduit surface and the first outer surface and the second outer surface jointly form at least a portion of an outer conduit surface, wherein the outer conduit surface has an airfoil geometry;

wherein the third segment is in sliding longitudinal engagement with the first segment and the second segment and forms a leading edge portion of the airfoil geometry of the outer conduit surface; and wherein the fourth segment is in sliding longitudinal engagement with the first segment and the second segment and forms a trailing edge portion of the airfoil geometry of the outer conduit surface.

2. The conduit of claim 1, wherein:

the first segment further comprises a first flange extending outward from the first outer surface;

the second segment further comprises a second flange extending outward from the second outer surface; and in an assembled state the first flange and the second flange are configured to abut and engage the common cap flange.

3. The conduit of claim 2, wherein:

the first segment comprises a first longitudinal edge and a second longitudinal edge;

the second segment comprises a third longitudinal edge and a fourth longitudinal edge;

the third segment is in longitudinal sliding engagement with the first longitudinal edge and the second longitudinal edge such that the first longitudinal edge is coupled to the third longitudinal edge via the third segment; and the fourth segment is in longitudinal sliding engagement with the second longitudinal edge and the fourth longitudinal edge such that the second longitudinal edge is coupled to the fourth longitudinal edge via the fourth segment.

4. The conduit of claim 1, wherein the third segment comprises one of a slot geometry and a complementary tab geometry, wherein the first longitudinal edge and the third longitudinal edge jointly form the other of the slot geometry and the complementary tab geometry.

5. The conduit of claim 1, wherein the fourth segment comprises one of a slot geometry and a complementary tab geometry, wherein the second longitudinal edge and the fourth longitudinal edge jointly form the other of the slot geometry and the complementary tab geometry.

6. A gas turbine engine comprising:

a first case structure;

a second case structure; and a conduit extending between the first case structure and the second case structure, wherein the conduit comprises a plurality of detachably coupled segments that jointly form an outer conduit surface having an airfoil geometry;

wherein the plurality of detachably coupled segments comprises a first segment, a second segment, a third segment, and a fourth segment, wherein each of the first segment, the second segment, the third segment, and the fourth segment forms at least a portion of the outer conduit surface;

wherein the first segment forms a first sidewall of the conduit, the second segment forms a second sidewall of the conduit, the third segment forms a leading edge portion of conduit, and the fourth segment forms a trailing edge portion of the conduit; and wherein the third segment is monolithic with the fourth segment such that the third segment and the fourth segment comprise a common cap flange extending between the third segment and the fourth segment.

7. The gas turbine engine of claim 6, wherein the first segment at least partially forms one of an upper surface and a lower surface of the airfoil geometry of the outer conduit surface and the second segment at least partially forms the other of the upper surface and the lower surface of the airfoil geometry of the outer conduit surface.

8. The gas turbine engine of claim 7, wherein the third segment couples the first segment to the second segment and forms a leading edge portion of the airfoil geometry of the outer conduit surface, wherein the fourth segment couples the first segment to the second segment and forms a trailing edge portion of the airfoil geometry of the outer conduit surface.

9. The gas turbine engine of claim 7, wherein:

the first segment further comprises a first flange extending outward from the one of the upper surface and the lower surface of the airfoil geometry of the outer conduit surface;

the second segment further comprises a second flange extending outward from the other of the upper surface and the lower surface of the airfoil geometry of the outer conduit surface; and in an assembled state the first flange and the second flange are configured to abut and engage the common cap flange.

10. A method of assembling a gas turbine engine, the method comprising:

inserting a first segment of a conduit through a first aperture formed in a first case structure of the gas turbine engine;

positioning at least one of an electronics cable and a tube for fluids relative to the first segment of the conduit;

inserting a second segment of the conduit through the first aperture formed in the first case structure of the gas turbine engine; and sliding a monolithic element comprising a third segment and a fourth segment along respective longitudinal edges of the first segment and the second segment to couple the first segment to the second segment, wherein an outer conduit surface of the conduit has an airfoil geometry.

11. The method of claim 10, wherein positioning the at least one of the electronics cable and the tube for fluids comprises mounting the at least one of the electronics cable and the tube for fluids to the first segment.

12. The method of claim 10, wherein the monolithic element comprises a common cap flange extending between the third segment and the fourth segment, wherein sliding the monolithic element along the respective longitudinal edges of the first segment and the second segment comprises abutting and engaging the common cap flange against a first flange of the first segment and a second flange of the second segment.

13. The method of claim 12, wherein positioning the at least one of the electronics cable and the tube for fluids is performed before sliding the monolithic element along the respective longitudinal edges of the first segment and the second segment.

* * * * *